US007929882B2

(12) United States Patent
Nakamura et al.

(10) Patent No.: US 7,929,882 B2
(45) Date of Patent: Apr. 19, 2011

(54) IMAGE DEVELOPMENT APPARATUS AND IMAGE FORMING APPARATUS USING THE SAME, AND IMAGE DEVELOPMENT METHOD AND IMAGE FORMING METHOD USING THE SAME

(75) Inventors: Masahide Nakamura, Fulham Gardens (AU); Masahiro Fukazawa, Chino (JP); Tsutomu Teraoka, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 832 days.

(21) Appl. No.: 11/859,607

(22) Filed: Sep. 21, 2007

(65) Prior Publication Data

US 2008/0076052 A1 Mar. 27, 2008

(30) Foreign Application Priority Data

Sep. 27, 2006 (JP) ..... 2006-262537
Sep. 27, 2006 (JP) ..... 2006-262538
Sep. 27, 2006 (JP) ..... 2006-262649
Jul. 6, 2007 (JP) ..... 2007-178252

(51) Int. Cl.
*G03G 15/10* (2006.01)

(52) U.S. Cl. ..... 399/159; 399/58; 430/103

(58) Field of Classification Search ..... 399/58, 399/159; 430/103
See application file for complete search history.

(56) References Cited

U.S. PATENT DOCUMENTS 6,353,716 B1 * 3/2002 Uehara et al. ..... 399/44
2005/0260007 A1 * 11/2005 Shimomura ..... 399/55

FOREIGN PATENT DOCUMENTS

JP 2002-278291 * 9/2002

OTHER PUBLICATIONS

Translation of JP 2002-278291 published Sep. 2002.*

* cited by examiner

*Primary Examiner* — Christopher RoDee
*Assistant Examiner* — Peter L Vajda
(74) *Attorney, Agent, or Firm* — DLA Piper LLP (US)

(57) ABSTRACT

An image development apparatus, including: a developer carrier that carries thereon a liquid developer being a carrier solution including dispersed toner particles each made of a coloring agent and a resin; a developer supply member that supplies the developer to the developer carrier; a developer compression member that is opposing the developer carrier, and compresses any solid content of the developer to a side of the developer carrier through application of an electric field to the developer on the developer carrier supplied by the developer supply member; a developer compression member voltage application unit that applies a voltage to the developer compression member; and a current detection unit that detects a current flowing from the developer compression member to the developer carrier.

9 Claims, 16 Drawing Sheets

SOLID PATCH

IMAGE DEVELOPMENT APPARATUS AND IMAGE FORMING APPARATUS USING THE SAME, AND IMAGE DEVELOPMENT METHOD AND IMAGE FORMING METHOD USING THE SAME

BACKGROUND

1. Technical Field

The entire disclosure of Japanese Patent Application Nos: 2006-262537, filed Sep. 27, 2006 and 2006-262538, filed Sep. 27, 2006 and 2006-262649, filed Sep. 27, 2006 and 2007-178252, filed Jul. 6, 2007 are expressly incorporated by reference herein.

The present invention relates to an image development apparatus using a liquid toner being a result of dispersing toner particles in a carrier solution, an image forming apparatus using the image development apparatus, an image development method, and an image forming method using the image development method.

2. Related Art

A previous image forming method using a liquid toner is described in Patent Document 1 (JP-A-2002-278291). Patent Document 1 describes an image forming method of using a developing roller carrying thereon a liquid toner for latent image development on a photosensitive element. In the method, a compression roller is used for compressing the liquid toner on the developing roller before image development, and a voltage is applied to both the developing roller and the compression roller in such a manner that the application voltage for the compression roller is higher than that for the developing roller. Such voltage application prevents any possible image fogging and inconsistencies in density so that the resulting images can be of high quality.

In an image forming apparatus, a toner layer on a developing roller is compressed and then is made like a film. This eases the movement of the toner layer in the later image developing and transferring so that the resulting images can be free from disturbance with high efficiency of image developing and transferring.

Considered here is a case where such an image forming apparatus uses a printing method of using a liquid developer, in which toner particles each at least made of a coloring agent and a resin are dispersed by a dispersant in a nonvolatile carrier solution. Such a printing method may possibly cause various types of changes to the developer in terms of characteristics, i.e., conductivity, electric-charge characteristics, size distribution of toner particles, mobility of toner particles, and others. The change of conductivity in the developer is caused due to any change observed in the developer over long-time running of an image forming apparatus, and any change occurred to the moisture content in the carrier solution as a result of moisture absorption due to the influence of temperature and humidity environment. The possible cause of the change of electric-charge characteristics is any change of moisture content, or any change observed in the condition of adhesion of a dispersant to toner particles as a result of any over-time change and temperature change. The change of size distribution of toner particles is caused by agglomeration of the toner particles, which is possibly caused by any change observed in a dispersant in terms of the condition of adhesion. The change of mobility of toner particles observed with respect to an electric field occurs as a result of these changes described above.

If with an image forming apparatus that collects, for recycle use, any developer not used for development to a photosensitive element as is transferred to a non-image portion of a developer carrier, some changes may be observed in a dispersant in terms of adhesion to the toner particles, i.e., the amount of dispersant to be adhered to the toner particles may be changed. This is because, in such an image forming apparatus, a developer to be reused for recycling purpose is the one having been passed through an electric field in the nip of a compression member formed with a developer carrier, i.e., compression member nip, and an electric field in the nip formed by the developer carrier and a photosensitive element, i.e., developer nip. Therefore, the toner particles are pushed against the developer carrier by the electric field of the compression member or that of the developer nip, i.e., non-image portion. As a result, the toner particles are pushed against one another, and this deteriorates the dispersion among the toner particles. The particles are thus agglomerated and are applied with an electric field so that the dispersant possibly falls off from the toner particles. This is the reason of the possible change in the dispersant in terms of adhesion to the toner particles, i.e., the amount change of the dispersant to be adhered to the toner particles. Moreover, in the developer nip, in an image portion, the toner particles are mostly subjected to development to a photosensitive element together with a carrier solution, and the carrier solution is partially left on the developer carrier. On the other hand, in a non-image portion, the tone particles are mostly remained on the developer carrier together with the carrier solution, and the carrier solution is partially transferred to the photosensitive element. As such, in the developer carrier after image development, a ratio between the toner particles and the carrier solution varies depending on the density of a printing image. With solid printing, for example, any developer showing a considerably high ratio for the carrier solution is remained on the developer carrier, and this developer is collected by a cleaner. As such, the liquid to be collected by a cleaner for recycling purpose has such a ratio different from that of the original developer, and unless otherwise adjusted, the developer is reused with a different ratio. Even if the developer is adjusted in ratio, depending on the adjustment accuracy, the resulting developer to be reused does not always have exactly the same ratio as that of the original developer. As a result, the developer may suffer from some changes of ratio between the toner particles and the carrier solution.

Such changes observed in a developer affect the behaviors of particles therein in a process of moving the particles by electric fields of a compression member nip, a developer nip, a transfer nip, and others. This resultantly causes problems of causing a change of image density, image disturbance in streaks called ribs, fogging over a non-image portion, and others.

SUMMARY

An advantage of some aspects of the invention is to provide an image development apparatus that swiftly detects any change occurred to the characteristics of a developer, an image forming apparatus using the image development apparatus, and an image development method, and an image forming method using the image development method.

An image development apparatus of the invention includes: a developer carrier that carries thereon a liquid developer being a carrier solution including dispersed toner particles each made of a coloring agent and a resin; a developer supply member that supplies the developer to the developer carrier; a developer compression member that is opposing the developer carrier, and compresses any solid content of the developer to the side of the developer carrier through application of an electric field to the developer on the developer carrier supplied by the developer supply member; a developer compression member voltage application unit that applies a voltage to the developer compression member; and a current detection unit that detects a current flowing from the developer compression member to the developer carrier. This configuration successfully enables detection of any change occurring to the characteristics of a developer based on fluctuations of a current, thereby enabling to quickly dealing with any problems if occurred.

The current detection unit performs averaging of a current value, for use as a detection value, being a result of performing current detection for a predetermined length of time. As such, the detection can be performed with good accuracy.

The developer supply member is an anilox roller formed with microscopic asperities on the surface so that the developer can be supplied with stability.

Moreover, the developer compression member voltage application unit includes a constant voltage control unit so that the solid content of a developer can be moved with stability.

A developer carrier voltage application unit is provided for applying a voltage to the developer carrier and the developer supply member, and the developer carrier voltage application unit includes a constant voltage control unit. With the configuration, a developer can be supplied with stability, and the solid content of the developer can be moved also with stability.

An image forming apparatus of another aspect of the invention uses the image development apparatus of the aspect of the invention and includes: a liquid developer dump unit that includes: an image carrier that is subjected to development of a latent image by the developer carrier; and a recycling device that collects, for reuse, any of the developer on the developer carrier corresponding to a non-image portion of the image carrier. The liquid developer dump unit entirely dumps the developer being in use based on data of the current detection unit. Accordingly, any possible image disturbance can be prevented from occurring without using any deteriorated developer.

The current detection unit and the liquid developer dump unit are disposed in the image development unit, which is provided for each of a plurality of colors so that a full-color image can be derived with high quality.

Moreover, a patch process is performed in accordance with the current detected by the current detection unit, and based on a patch density, a setting is made for image forming requirements. Accordingly, any change occurring to a developer is determined, and a patch is formed as needed so that image forming requirements leading to an appropriate image density are to be set again. In this manner, even if the developer suffers from any change, the resulting images can be of a satisfactory level.

Moreover, when the current detected by the current detection unit falls outside a predetermined range of a reference value set therefor at the time of activating the image forming apparatus, the patch process is performed, and the setting is made for the image forming requirements based on the patch density. Accordingly, the patch process can be executed with good accuracy.

The image forming requirements are an application voltage of the developer carrier and that of the image carrier so that the resulting image can be high in quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
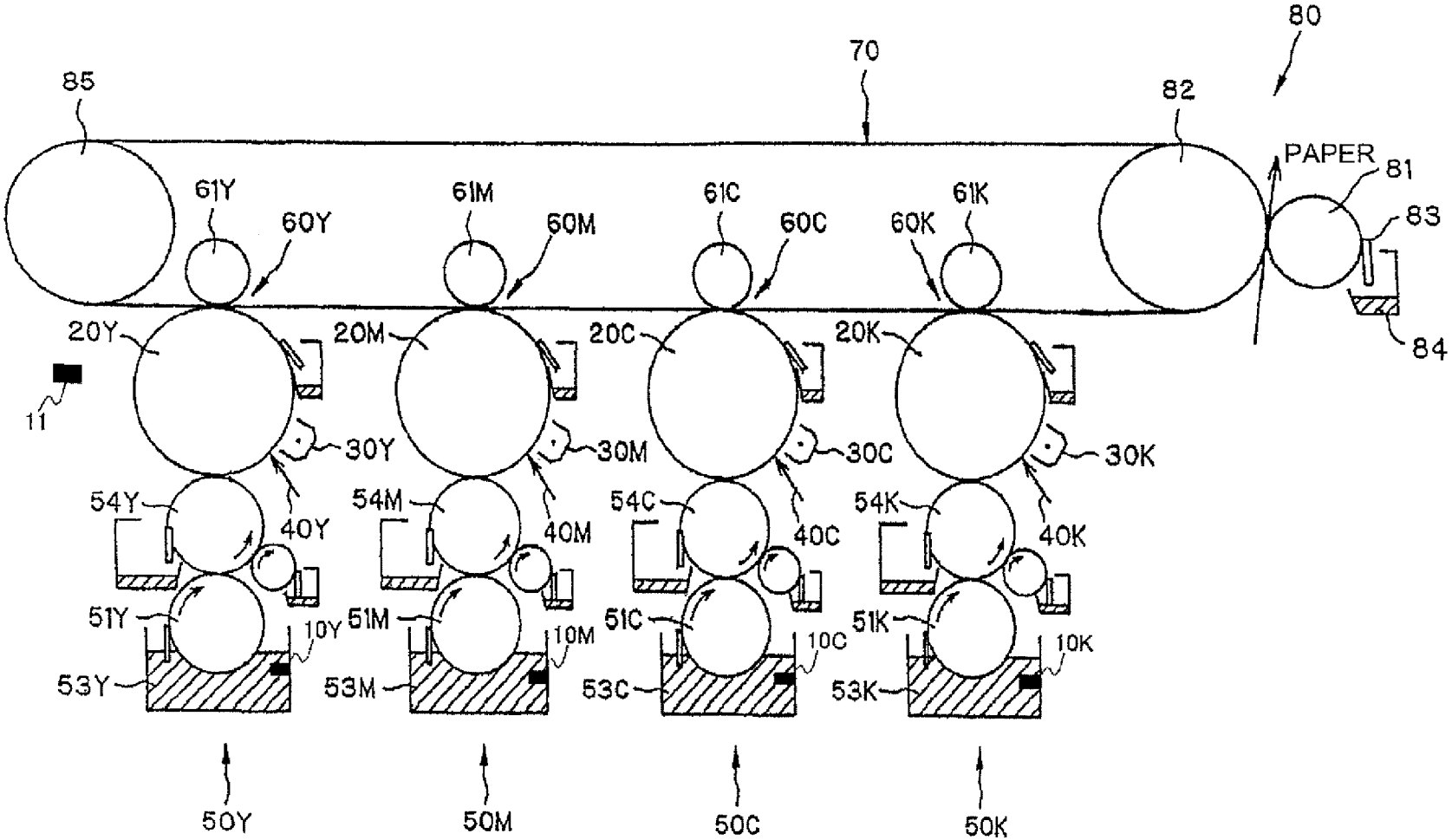
FIG. 1 is a diagram showing an image forming apparatus in an embodiment of the invention.

Embodiments of the invention are described by referring to the accompanying drawings. FIG. 1 is a diagram showing the main configuration of an image forming apparatus in an embodiment of the invention.

An intermediate transfer belt 70 is an endless belt being placed across a belt drive roller 82 and a follower roller 85. The intermediate transfer belt 70 is rotate-driven while coming in contact with photosensitive elements 20Y, 20M, 20C and 20K. The intermediate transfer belt 70 configures, respectively, primary transfer units 60Y, 60M, 60C, and 60K together with primary transfer backup rollers 61Y, 61M, 61C, and 61K and the photosensitive elements 20Y, 20M, 20C, and 20K. With the primary transfer units 60Y, 60M, 60C and 60K, liquid toners of four colors are sequentially transferred, one on the other, onto the intermediate transfer belt 70 so that a full-color liquid toner image is formed. In the embodiment, used is a liquid developer being a result of dispersing toner particles in a carrier solution. The toner particles are those made of a coloring agent and a resin.

A secondary transfer unit 80 is configured to include a secondary transfer roller 81, the intermediate transfer belt drive roller 82, a secondary transfer roller blade 83, and a secondary transfer roller cleaning liquid collection section 84. The secondary transfer unit 80 transfers toner images formed on the intermediate transfer belt 70 onto a recording medium such as paper. The toner images include a monochrome liquid toner image and a full-color liquid toner image.

A fuser unit (not shown) serves to fuse the toner images transferred on the recording medium, i.e., monochrome liquid toner image and full-color liquid toner image, and make those as permanent images.

Image developing units 50Y, 50M, 50C, and 50K respectively serve to perform latent image development using liquid toners of yellow (Y), magenta (M), cyan (C), and black (K).

The image developing units 50Y, 50M, 50C, and 50K are respectively configured by, mainly, developer toner containers 53Y, 53M, 53C, and 53K, toner supply rollers 51Y, 51M, 51C, and 51K, electric chargers 30Y, 30M, 30C, and 30K, and exposure units 40Y, 40M, 40C, and 40K. The developer toner containers 53 are each for storing therein a liquid toner, and the toner supply rollers 51 are for supplying the liquid toners from the developer toner containers to developing rollers 54Y, 54M, 54C, and 54K. The electric chargers 30 are for electrically charging the photosensitive elements 20Y, 20M, 20C, and 20K, and the exposure units 40 are each for forming an electrostatic latent image to the electrically-charged photosensitive element.

The image forming apparatus includes therein temperature sensors 10 and a humidity sensor 11.

The developing units 50Y, 50M, 50C, and 50K share the same configuration, and thus the developing unit 50K is mainly described in the below.

As shown in FIG. 1, the components, i.e., the electric charger 30K, the exposure unit 40K, and the primary transfer unit 60K, are mainly disposed along the rotation direction of the photosensitive element 20K. The photosensitive element 20K includes a cylindrical base material and a photosensitive layer formed on the perimeter surface thereof. The photosensitive element 20K is rotatable about a center axis, and in this embodiment, rotates in a clockwise direction.

The electric charger 30K serves to electrically charge the photosensitive element 20K. The exposure unit 40K includes a semiconductor laser, a polygon mirror, an F-θ lens, and others. The exposure unit 40K exposes the electrically-charged photosensitive element 20K to any modulated lasers so that a latent image is formed.

The developing unit 50K serves to develop the latent image formed on the photosensitive element 20K using a liquid toner of black (K). The developing unit 50K will be described later.

The primary transfer unit 60K serves to transfer a toner image formed by the liquid toner of black on the photosensitive element 20K to the intermediate transfer belt 70.

Figure 2:
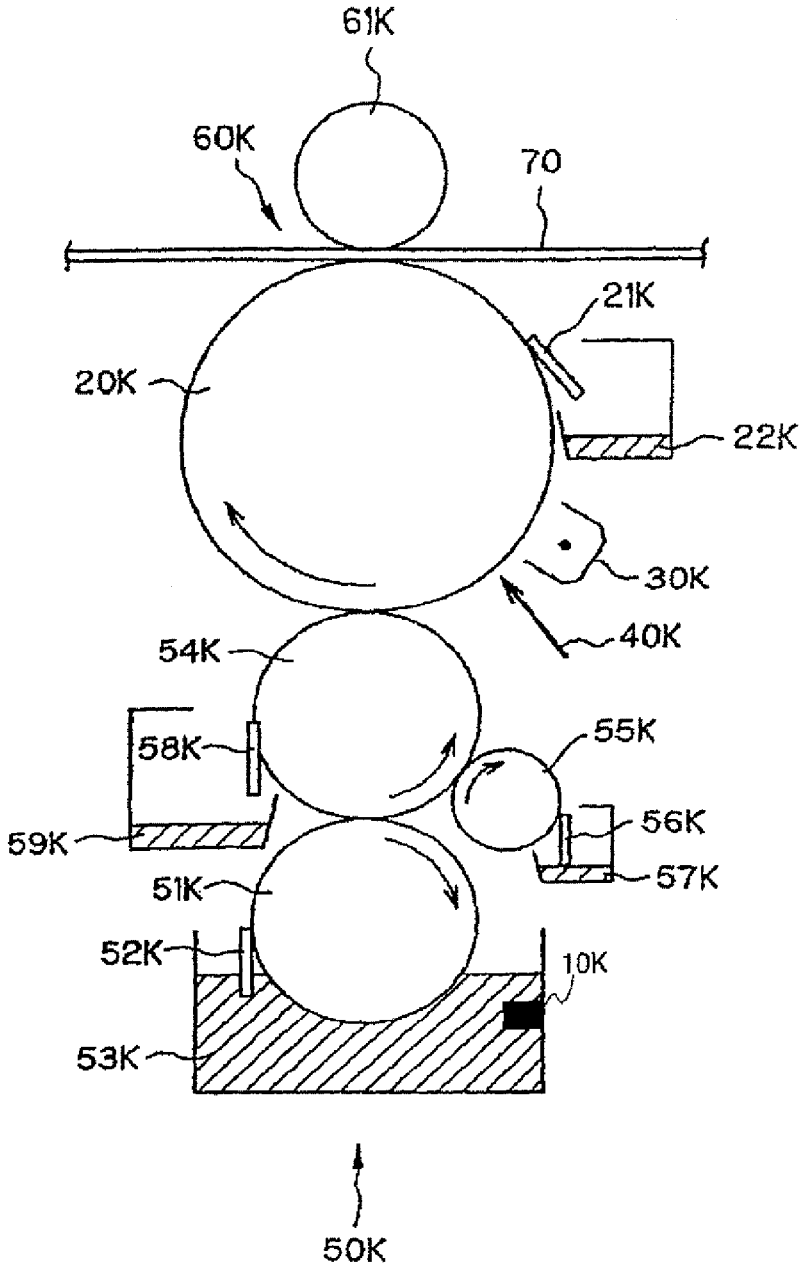
FIG. 2 is a diagram showing apart of the image forming apparatus in the embodiment.

FIG. 2 is a cross sectional diagram showing the main components of the developing unit 50K. The developer toner container 53K stores therein a liquid toner of black for use for developing a latent image formed on the photosensitive element 20K. The liquid toner in this embodiment is nonvolatile at room temperatures with a high viscosity of about 30 to 10000 mPa·s with the solid concentration of about 25%. This liquid toner is formed by solid particles with an average size of 1 μm being put into a liquid solvent together with a dispersant. The solid particles are derived by dispersing a coloring agent such as pigment into a thermoplastic resin, and the liquid solvent is exemplified by organic solvent, silicon oil, mineral oil, edible oil, or others.

Figure 3:
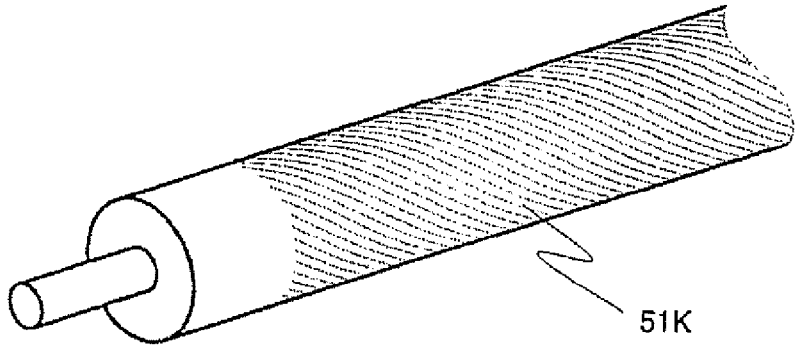
FIG. 3 is a perspective view of a developer supply member.
Figure 4:
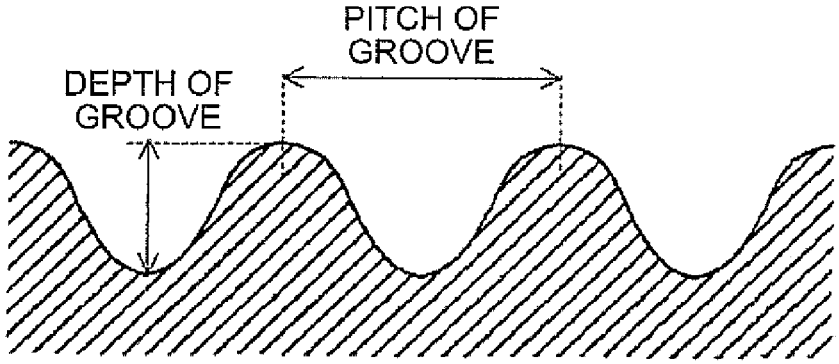
FIG. 4 is a diagram showing grooves of the developer supply member in the embodiment.

From the developer toner container 53K, by the toner supply roller 51K, a liquid toner is supplied to the developing roller 54K. The toner supply roller 51K is a cylindrical member, and rotates in a clockwise direction as shown in FIG. 2. The toner supply roller 51K is an anilox roller formed with microscopic and uniform helical grooves on the surface. The grooves are formed with a pitch of about 130 μm, and a depth of about 30 μm. FIG. 3 is a perspective view of a toner supply roller 51K, and FIG. 4 is a diagram showing the pitch and depth of the grooves formed to the toner supply roller 51K.

Figure 5:
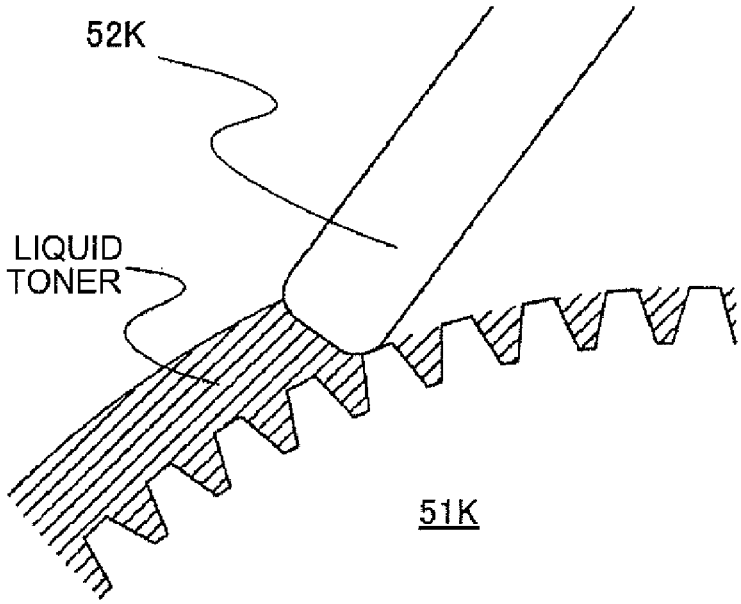
FIG. 5 is a diagram showing a developer restriction member in the embodiment.

A toner restriction blade 52K is configured by a rubber portion and a plate made of metal or others, and scrapes off and removes any liquid toner remained on the toner supply roller 51K. The rubber portion is made of polyurethane rubber or others, and is made to come in contact with the surface of the toner supply roller 51K, and the metal plate is provided to support an external rubber portion. FIG. 5 is a diagram showing how the toner restriction blade 52K works to restrict the amount of toner.

The developing roller 54K is a cylindrical member, and rotates in a counterclockwise direction about a center axis as shown in FIG. 2. The developing roller 54K is configured by, on a perimeter portion of an inner core made of metal such as iron, an elastic body made of conductive urethane rubber or others, and a resin layer or a rubber layer. The developing roller 54K is provided with a developing roller blade 58K and a developing roller cleaning liquid collection section 59K. The developing roller blade 58K is made of rubber or others to come in contact with the surface of the developing roller 54K, and scrapes off and removes any liquid toner remained on the developing roller 54K. The developing roller cleaning liquid collection section 59K is a container for storing the liquid toner scraped off by the developing roller blade 58K.

The compression roller 55K is a cylindrical member, and rotates about a center axis. The compression roller 55K includes, on the surface layer of the metallic roller, a conductive resin layer and a rubber layer. As shown in FIG. 2, the compression roller 55K rotates in a clockwise direction, which is opposite to the rotation direction of the developing roller 54K. To the compression roller 55K, a voltage is applied separately from the developing roller 54K, and as such, there is a potential difference between these rollers. A compression roller blade 56K is made of rubber or others to come in contact with the surface of the compression roller 55K, and scrapes off and removes any liquid toner remained on the compression roller 55K. A compression roller cleaning liquid collection section 57K is a container for storing the liquid toner scraped off by the compression roller blade 56K.

The photosensitive element 20K is wider in width than that of the developing roller 54K, and is a cylindrical member formed with a photosensitive layer on the peripheral surface. As shown in FIG. 2, the photosensitive element 20K rotates in a clockwise direction about a center axis. The photosensitive layer of the photosensitive element 20K is an organic photosensitive element, an amorphous silicon photosensitive element, or others.

The electric charger 30K is disposed on the upstream of a nip portion between the photosensitive element 20K and the developing roller 54K. The electric charger 30K electrically charges the photosensitive element 20K through application by a power supply unit (not shown) of a bias of the same polarity as a liquid toner. The electrically-charged photosensitive element 20K is exposed to lasers coming from the exposure unit 40K so that a latent image is formed. The resulting latent image is developed by the developing roller 54K, and is primarily transferred to the intermediate transfer belt 70 in the primary transfer unit 60K.

Described next is the operation of such an image forming apparatus. Exemplified below is also the developing unit 50K out of four others.

A liquid toner in the developer toner container 53K has the solid concentration of 25% with the viscosity of 30 to 10000 mPa/s, and the toner particles are positively charged. The liquid toner is pumped up from the developer toner container 53K by the rotation of the toner supply roller 51K. The toner restriction blade 52K comes in contact with the surface of the toner supply roller 51K so that any extra developer is scraped off thereby except the developer in the grooves formed on the surface of the toner supply roller 51K. With scraping as such, the amount of liquid toner is restricted for supply to the developing roller 54K. Through such restriction, the liquid toner for coating on the developing roller 54K is subjected to quantification in such a manner as to be 6 μm in thickness. The liquid toner scraped off by the toner restriction blade 52K drops into the developer toner container 53K by gravitation. To the toner supply roller 51K, a voltage in a range of +300 to +500V or higher is applied.

The developing roller 54K coated with the liquid toner comes in contact with the compression roller 55K on the downstream of the nip portion with the toner supply roller 51K. To the developing roller 54K, a voltage in a range of +300 to +500V, e.g., +400V, is applied. Applied to the compression roller 55K is a voltage higher, by 200 to 500V, than the voltage applied to the developing roller 54K. That is, if the application voltage for the developing roller 54K is +400V, the compression roller 55K is applied with a voltage in a range of +600 to +900V, e.g., +800V. With such a voltage difference, the toner on the developing roller 54K is moved to the side of the developing roller 54K when passing through the nip portion with the compression roller 55K so that the compression roller 55K is provided only with a carrier solution including almost no toner particle. As such, the toner particles are smoothly coupled together, thereby being like a film. This accordingly quickens the toner movement in the developing section so that the image density is improved.

The compression roller 55K rotates in a direction of accompanying the surface of the developing roller 54K with a constant speed. Note here that, alternatively, the compression roller 55K may be rotated with a speed different from that of the developing roller 54K, or may be rotated in a counter direction opposing the surface of the developing roller 54K. With the compression roller 55K, the compression roller blade 56K comes in contact, but provision of the compression roller blade 56K is not a must. If this is the case, the compression roller 55K retains thereon carriers with a fixed film thickness, and the amount of carriers of the toner layer on the developing roller 54K shows no change around the nip portion with the compression roller 55K.

The photosensitive element 20K is made of amorphous silicon, and is electrically charged on the surface to be a range of about +500V to +600V, e.g., +600V. This electric charge is made through application of a voltage in a range of about +4.5 kV to +5.5 kV to a wire of the corona electric charger 30K on the upstream of the nip portion with the developing roller 54K. After electric charge as such, the exposure unit 40K forms a latent image in such a manner that the image portion has an electric potential in a range of about +20 to +50V, e.g., +25V. In the developer nip portion formed between the developing roller 54K and the photosensitive element 20K, the toner particles are selectively moved to the image portion on the photosensitive element 20K. This selective movement of the toner particles is made in accordance with the bias +400V having been applied to the developing roller 54K, and the electric field formed by the latent image on the photosensitive element 20K, i.e., image portion +25V, and non-image portion +600V. As a result of such selective movement of the toner particles, a toner image is formed on the photosensitive element 20K. As being not under the influence of an electric field, the carrier solution is subjected to separation at an outlet of the developer nip portion between the developing roller 54K and the photosensitive element 20K, and then is adhered to both the developing roller 54K and the photosensitive element 20K.

After passing through the developer nip portion, the photosensitive element 20K passes through a nip portion with the intermediate transfer belt 70 so that primary transfer is performed. The primary transfer backup roller 61K is being applied with a voltage of about −200V being opposite in polarity to the toner particles, i.e., electric charge characteristics. The toner particles on the photosensitive element 20K are primarily transferred onto the intermediate transfer belt 70 so that only a carrier solution is left on the photosensitive element 20K. The carrier solution left on the photosensitive element 20K is scraped off by a photosensitive blade 21K on the downstream of the primary transfer portion, and then is collected by a photosensitive cleaning liquid collection section 22K.

The toner image being a result of primary transfer by the primary transfer unit 60K onto the intermediate transfer belt 70 is directed to the secondary transfer unit 80. In the secondary transfer unit 80, the secondary transfer roller 81 is being applied with a voltage of −1000V, and the intermediate transfer belt drive roller 82 is retained at 0V. The toner particles on the intermediate transfer belt 70 are secondarily transferred to a recording medium such as paper.

Figure 6:
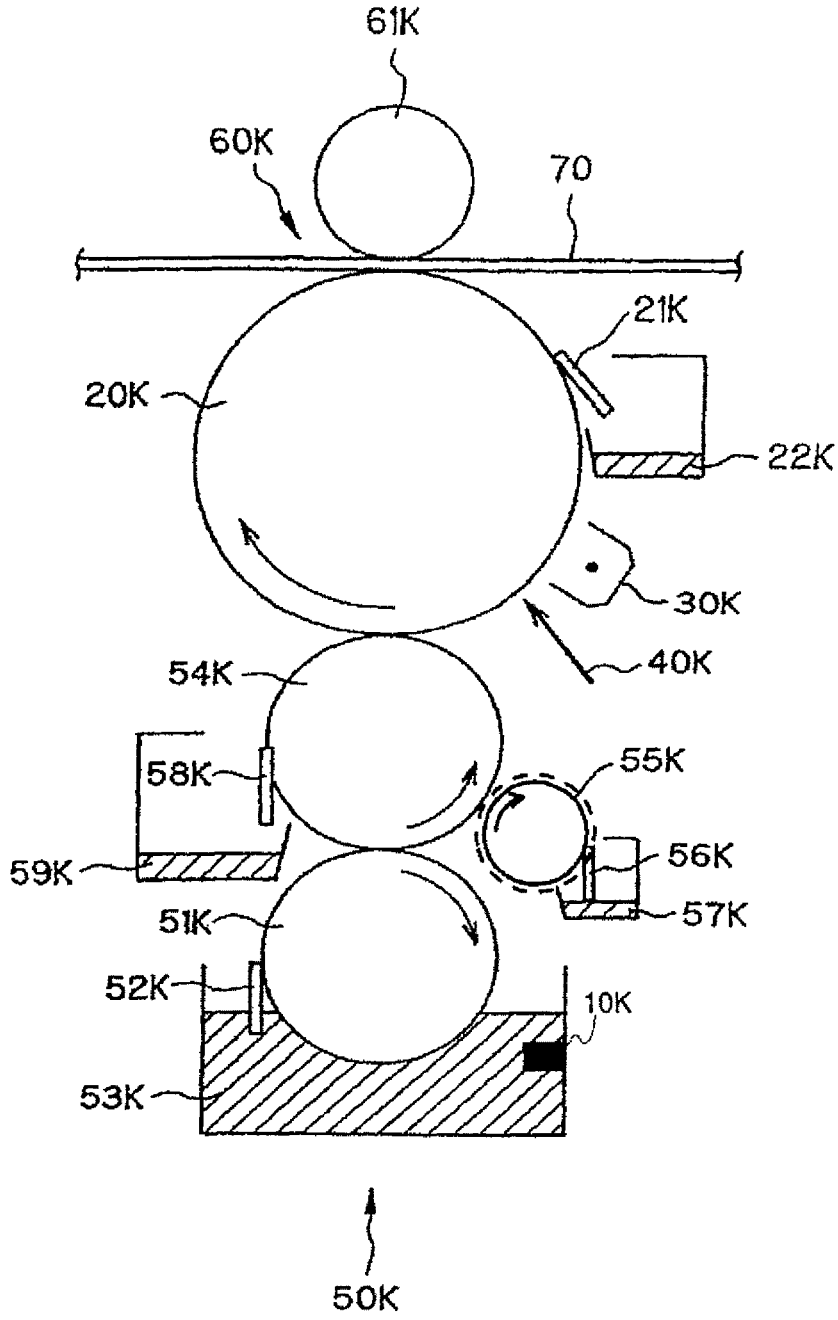
FIG. 6 is a diagram showing a part of an image forming apparatus in another embodiment of the invention.
Figure 7:
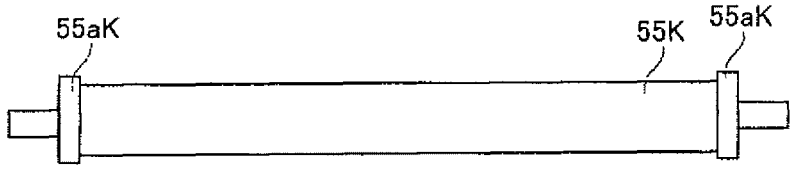
FIG. 7 is a diagram showing a compression roller with a gap.

FIG. 6 is a cross sectional diagram showing the main components of the developing unit 50K in a second embodiment, and FIG. 7 is a diagram showing the compression roller 55K. As shown in FIG. 6, the compression roller 55K is not necessarily in contact with the developing roller 54K. As shown in FIG. 7, the gap between the compression roller 55K and the developing roller 54K is formed by a gap material 55*a*K, which is provided at both ends of the compression roller 55K, and the gap distance is set to about 50 μm. As shown in FIG. 6, although the compression roller 55K is not in contact with the developing roller 54K, with a possibility of a developer attaching to the compression roller 55K, the provision of the compression roller blade 56K is considered preferable.

In the image forming procedure in such an image forming apparatus, the characteristics of a toner sometimes show some change due to deterioration of the toner resulted from long-time running of the apparatus, any environmental influence, accidental wrong toner refill, e.g., wrong manufacturing lot, and others. If with changes of toner characteristics as such, the manner of compressing an electric field is changed. As a result, any change observed in the toner characteristics causes a state change of compression and a problem such as inconsistencies in density due to ribs, poor cleaning, and unsatisfactory image developing.

Any change occurred to the characteristics of a developer, i.e., any change observed in conductivity, electric-charge characteristics, size distribution of toner particles, adhesion of a dispersant to toner particles, and a ratio between toner particles and carrier solution, becomes evident with the different behavior of toner particles in a carrier solution under the electric field between the compression roller 55K and the developing roller 54K, or with the change of resistance in the developer layer. Eventually, any change occurred to the characteristics of a developer becomes evident with a change of a current flowing from the compression roller 55K to the developing roller 54K. As such, monitoring a current enables to detect any change occurring to the characteristics of a developer.

Figure 8:
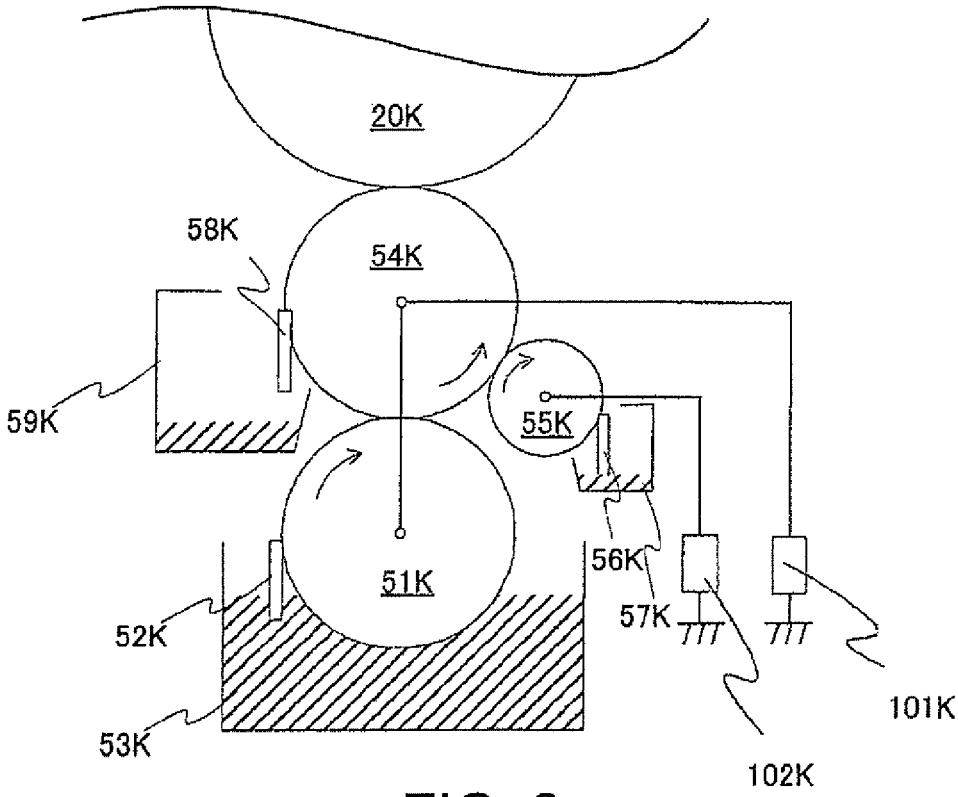
FIG. 8 is a diagram showing a voltage application unit in the embodiment.

With the image forming method of the embodiment of the invention, as shown in FIG. 8, monitoring a current from a power supply being a source of voltage application to the compression roller 55K enables to quickly dealing with any problems if occurred. In the drawing, a reference numeral 101K denotes a developing roller voltage application unit being an example of the developer carrier voltage application unit, and a reference numeral 102K denotes a compression roller voltage application unit being an example of the developer compression member.

The developing roller 54K and the toner supply roller 51K are both connected with the same developing roller voltage application unit 101K, and are both applied with a bias voltage of the same level. The compression roller 55K is connected with the separately-provided compression roller voltage application unit 102K, and a bias applied thereto is higher than that to the developing roller 54K. As such, the voltage applied to the compression roller voltage application unit 102K causes a current to flow from the compression roller 55K to the developing roller 54K. The current from the compression roller voltage application unit 102K is monitored by a current detection unit A.

The developing roller voltage application unit 101K and the compression roller voltage application unit 102K are each provided with a constant-current control unit, and are put under the constant-current control. Through such control, the toner on the developing roller 54K is moved to the side of the developing roller 54K when passing through a nip with the compression roller 55K so that the compression roller 55K is provided only with a carrier solution including almost no toner particle. As such, the toner particles are smoothly coupled together, thereby being like a film. This accordingly quickens the toner movement in the developing section so that the image density is improved.

Figure 9:
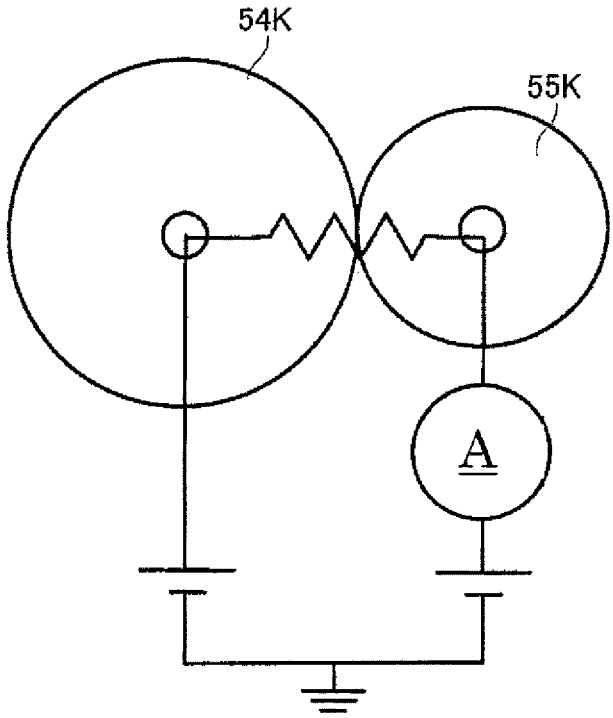
FIG. 9 is a diagram showing the placement configuration of a current detection unit.
Figure 10:
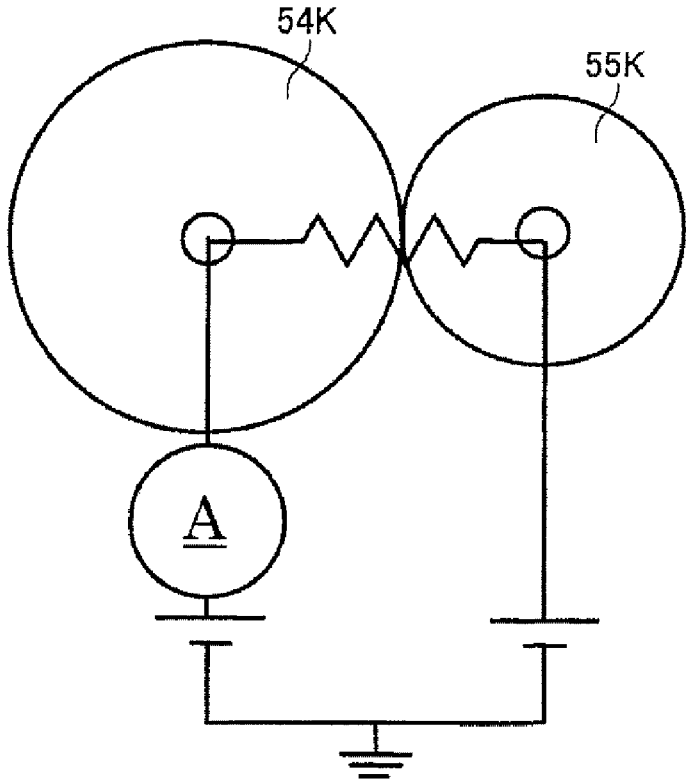
FIG. 10 is another diagram showing the placement configuration of the current detection unit.

The current detection unit A may be disposed on the side of the compression roller voltage application unit 102K as shown in FIG. 9, or on the side of the developing roller voltage application unit 101K as shown in FIG. 10.

Figure 11:
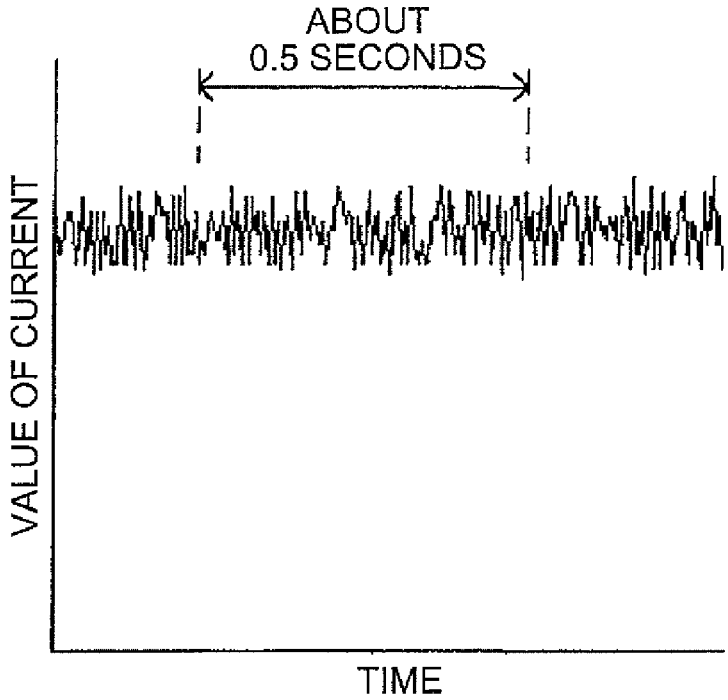
FIG. 11 is a diagram showing value fluctuations of a high-frequency current coming from the compression roller voltage application unit.

FIG. 11 is a diagram showing value fluctuations of a high-frequency current coming from the compression roller voltage application unit 102K. As shown in FIG. 11, the value fluctuations occur to a high-frequency current in response to the rotation of the compression roller 55K. To neglect the influence thereof, for actual monitoring, a time average of about 0.5 second is taken for reference use.

Note here that a compression current may be detected not only at the time of apparatus activation but also during a between-paper process in a printing job. If monitoring of a compression current is performed by the current detection unit A during such a no-printing period, the photosensitive element 20K is not electrically charged, and a voltage difference between the developing roller 54K and the compression roller 55K is set lower than that during a printing period. As an exemplary setting, a bias to the developing roller 54K is set to −200V, a bias to the compression roller 55K is set to +100V, a bias to the primary transfer backup roller 61K is set to 0V, and a bias to the secondary transfer roller 81 is set to 0V. With such a setting, a toner is not allowed to move to the photosensitive element 20K during detection of a compression current.

Monitoring is performed as such to a current coming from a power supply being a source of voltage application to the compression roller 55K. The monitoring result, i.e., fluctuations of a current value, accordingly helps detection of any change occurred to the characteristics of a developer, thereby enabling to quickly dealing with any problems if occurred.

Described next is a process enabled by monitoring of a current of the compression roller 55K as such in the following first to fourth examples.

Figure 12:
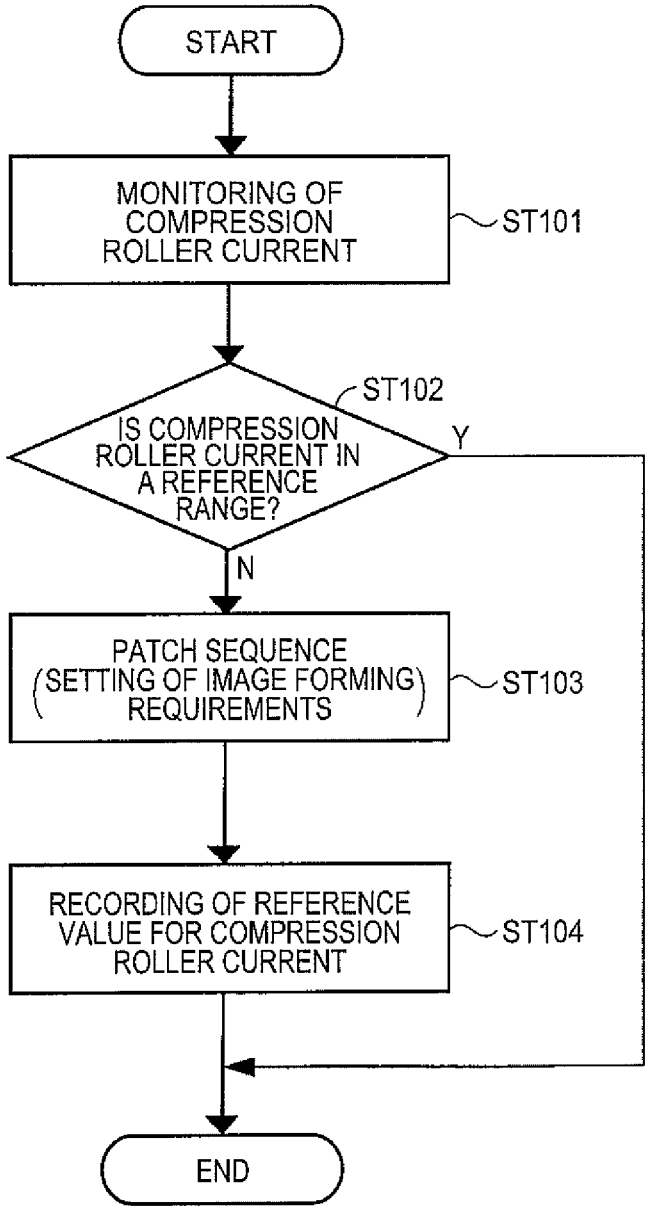
FIG. 12 is a diagram of a control flowchart in a first example.

The first example is about setting control over image forming requirements as shown in FIG. 12. In this example, a patch sequence is performed in advance at the time of apparatus activation, and a reference value is set in advance to a current of the compression roller 55K. First in step 101, the compression roller 55K is subjected to detection of a current (ST101). Then in step 102, a determination is made whether the detected current is equal to the previously-set reference value or falling in a range of ±30% thereof (ST102) When the current value falls in the range of ±30% of the reference value, this is the end of the setting control over the image forming requirements. When the current value is not falling in the range of ±30% of the reference value, a patch sequence is performed in step 103 so that the image forming requirements are set (ST103). Then in step 104, the current value of the compression roller 55K at the setting time of the image forming requirements is recorded, and the resulting value is set as a new reference value (ST104). This is the end of the setting control over the image forming requirements.

Described now is the patch sequence. In the patch sequence in this example, a voltage is first determined for application to the developing roller 54K, and then another voltage is determined for application to the electric charger 30K of the photosensitive element 20K.

Figure 13:
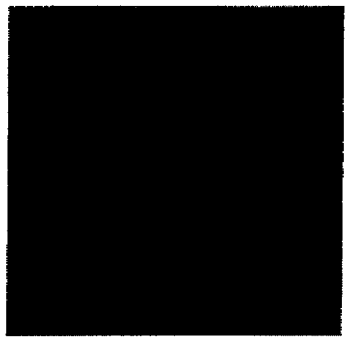
FIG. 13 is a diagram showing a solid patch in the embodiment.
Figure 14:
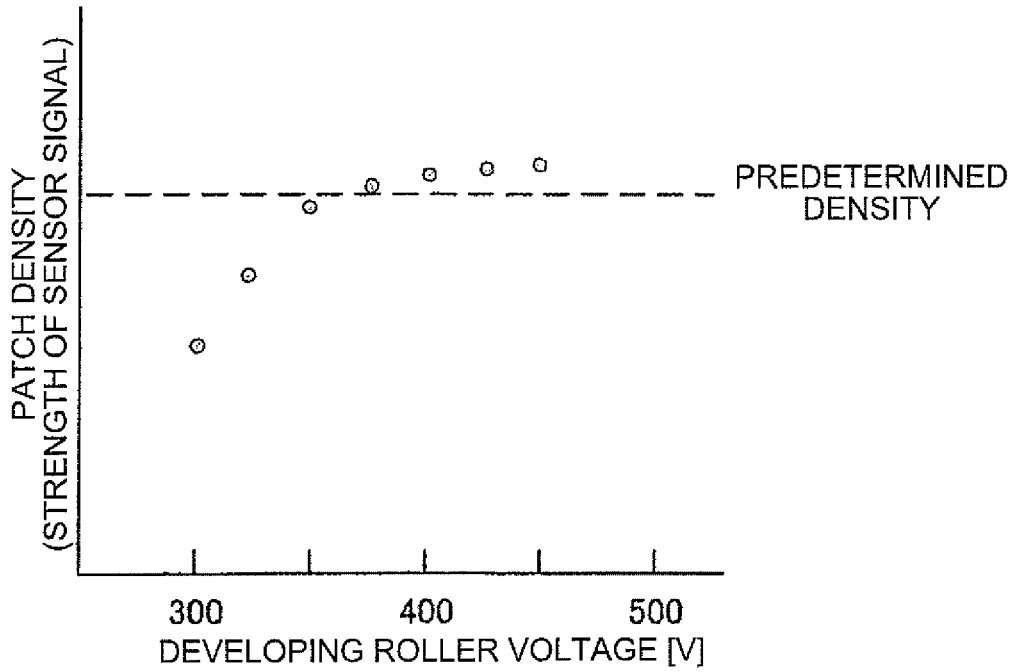
FIG. 14 is a diagram showing a patch density with respect to a developing roller voltage.

Such a solid patch as shown in FIG. 13 is formed by increasing, from +300V, the voltage for application to the developing roller in increments of 25V. During such patch formation, the patch density is checked for every voltage increase, and when the density reaches any predetermined value, the patch sequence is ended, and the application voltage at this time is used. In this sequence, the application voltage to the compression member is so set as to be different, by a fixed value, from that to the developing roller. FIG. 14 shows the patch density with respect to the application voltage to the developing roller, i.e., the signal strength of a patch sensor. That is, if a voltage is too low for application to the developing roller, this hinders the movement of the toner particles from the developing roller to the photosensitive element. If this is the case, the toner is not enough in amount on an image portion on the photosensitive element, and at the outlet of the developer nip, the toner particles exist on an interface where the liquid flows and separates. This resultantly causes disturbance due to ribs, and these problems reduce the patch density down to a value lower than the predetermined value. In FIG. 14 example, because the patch density reaches the predetermined value with the voltage of 375V for the developing roller, the new voltage for the developing roller is set to 375V.

Figure 15:
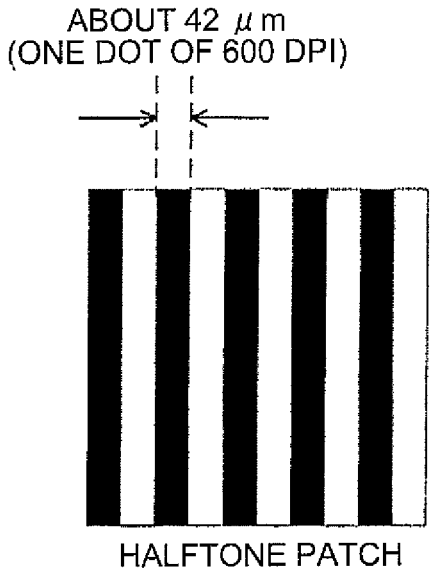
FIG. 15 is a diagram showing a halftone patch in the embodiment.
Figure 16:
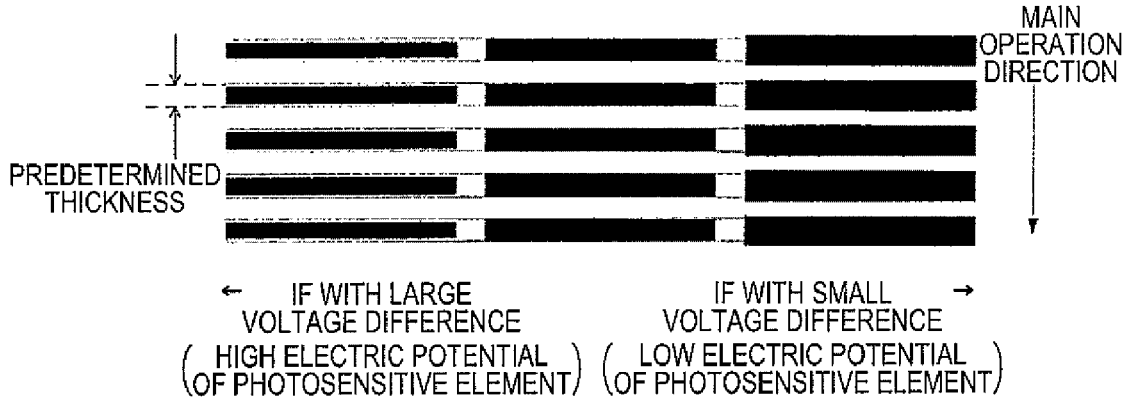
FIG. 16 is a diagram showing halftone patch with respect to a voltage difference between a photosensitive element and a developing roller.
Figure 17:
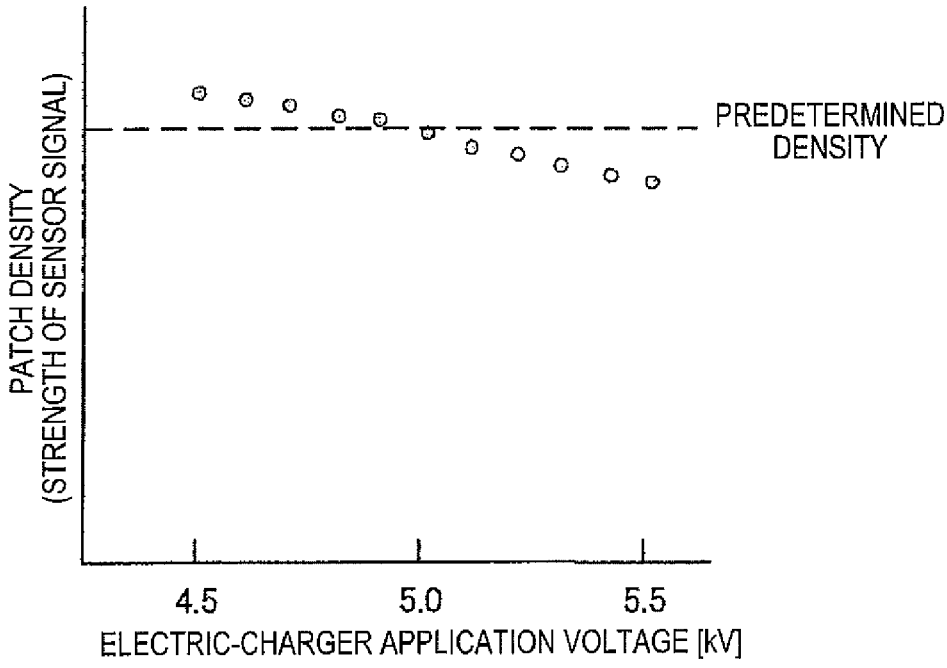
FIG. 17 is a diagram showing the patch density with respect to an electric-charger application voltage.

Thereafter, an application voltage is determined for the photosensitive electric charger. The application voltage for the developing roller is the value determined in the above-described sequence. First of all, a patch is formed by increasing, from +4.5 V, the voltage for application to the wire of the electric charger in increments of 0.1 kV. During such patch formation, the patch density is checked for every voltage increase, and when the density reaches any predetermined value, the patch sequence is ended, and the application voltage for the wire at this time is used. The patch is formed with such a halftone pattern as shown in FIG. 15, i.e., configured by a group of lines, i.e., 1 on 1 off, in the main operation direction. As shown in FIG. 16, the lines of the pattern show a change with respect to a latent image depending on the difference between the application voltage to the developing roller and the electrical-charge bias to the photosensitive element. That is, as shown in FIG. 17, as the voltage difference is increased, white lines occupy more in the area, i.e., ratio of white lines to black lines shows an increase, and the patch density is decreased. In FIG. 16 example, the patch density reaches a predetermined value or larger with the voltage of 4.9 kV, and reaches a predetermined value or smaller with the voltage of 5.0 kV, and thus the voltage of 4.9 kV is used.

Figure 18:
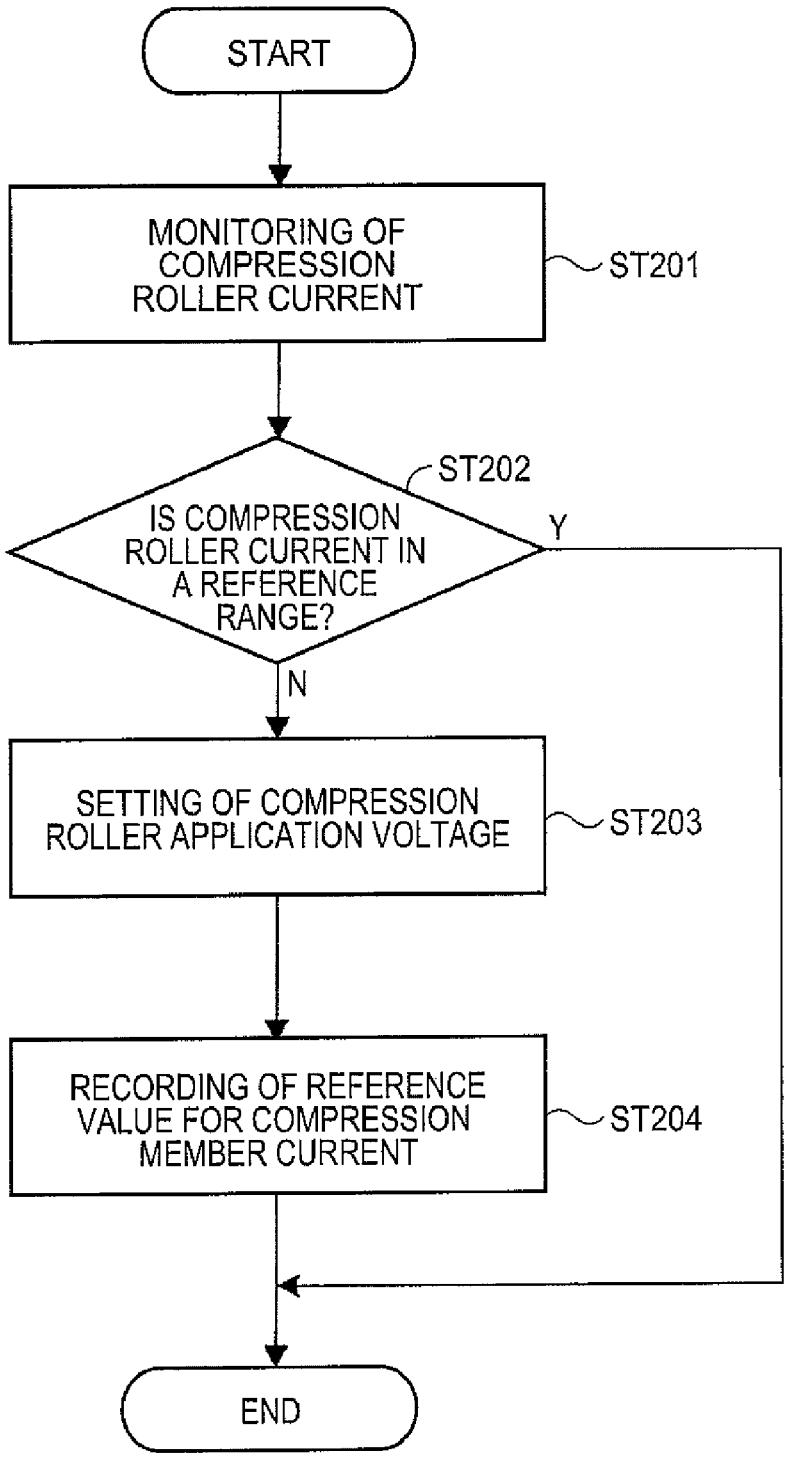
FIG. 18 is a diagram of a control flowchart in a second example.

Described next is a second example. The second example is about setting control over an application voltage for the compression roller 55K as shown in FIG. 18. First of all, in this example, the compression roller 55K is set with a voltage with respect to the temperature and humidity detected by the temperature sensor 10 and the humidity sensor 11 of FIG. 1. This voltage setting is made in advance at the time of activating the image forming apparatus based on a relational expression.

First of all, in step 201, the compression roller 55K is subjected to detection of a current (ST201). Then in step 202, a determination is made whether the detected current is equal to the previously-set reference value or falling in a range of ±10% thereof (ST202). When the current value falls in the range of ±10% of the reference value, this is the end of the setting control over the application voltage to the compression roller 55K. When the current value is not falling in the range of ±10% of the reference value, the compression roller 55K is set with an application voltage in step 203 (ST203). Then in step 204, the current value of the compression roller 55K at the setting time of the application voltage for the compression roller 55K is recorded, and the resulting value is set as a new reference value (ST204) This is the end of the setting control over the application voltage to the compression roller 55K.

For preparing a relational expression for use to set a voltage value to the compression roller 55K with respect to the temperature and humidity, a consideration is given to the fact that a low voltage will do if with the high temperature of the developer, and a high voltage will be required if with the high humidity in the apparatus. That is, when the developer is high in temperature, the carrier solution is reduced in viscosity so that the toner particles become easy to move. When the apparatus is high in humidity, the moisture content is increased in the developer, and the resistance is reduced in the developer so that the any extra current becomes easy to flow. In this embodiment, this relational expression is for value setting of a voltage difference between the compression roller 55K and the developing roller 54K with respect to the temperature and humidity and is represented by the following relational expression.

$$\Delta V=(410-T\times 3)+(H-20) \quad (1)$$

In the relational expression, ΔV denotes a voltage difference (V) between the compression roller 55K and the developing roller 54K, T denotes the temperature of a developer (degrees), and H denotes the humidity in an apparatus (%). The temperature of the developer is measured by the temperature sensor 10 in the developer toner container 53K, and the humidity in the apparatus is measured by the humidity sensor 11. If the temperature T of a developer is 35 degrees, and if the humidity H in the apparatus is 40%, ΔV=325 V. That is, when the application voltage to the developing roller is 350V, the compression member is applied with a voltage of 675V. Note that, in this embodiment, the equation is used to set a voltage difference between the compression roller 55K and the developing roller 54K with respect to the temperature and humidity. Alternatively, a table or others may be provided in advance for a voltage difference between the compression roller 55K and the developing roller 54K with respect to the temperature and humidity.

Figure 19:
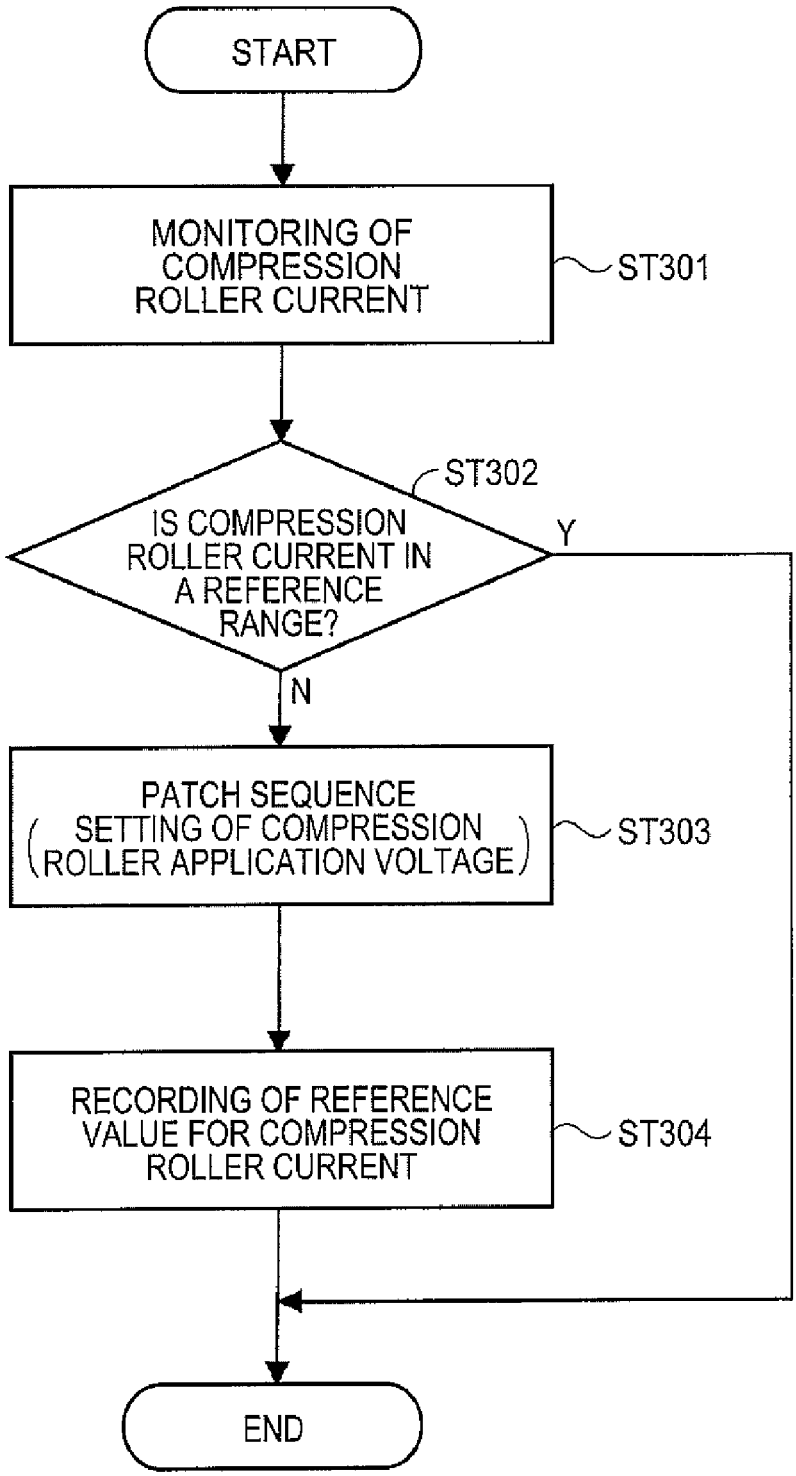
FIG. 19 is a diagram of a control flowchart in a third example.

Described next is a third example. The third example is about setting control over an application voltage to the compression roller 55K as shown in FIG. 19. First of all, in this example, a patch sequence is performed to set a reference value for the current of the compression roller 55K. This setting is made in advance at the time of activating the image forming apparatus. In step 301, the compression roller 55K is subjected to detection of a current (ST301). Then in step 302, a determination is made whether the detected current is equal to the previously-set reference value or falling in a range of ±20% thereof (ST302). When the current value falls in the range of ±20% of the reference value, this is the end of the setting control over the application voltage to the compression roller 55K. When the current value is not falling in the range of ±20% of the reference value, the patch sequence is performed in step 303 to set an application voltage to the compression roller 55K (ST303). Then in step 304, the current value of the compression roller 55K at the setting time of the application voltage for the compression roller 55K is recorded, and the resulting value is set as a new reference value (ST304) This is the end of the setting control over the application voltage to the compression roller 55K.

Described next is the patch sequence in the third example, With the patch sequence in this example, the compression roller 55K is determined with a voltage for application thereto. First of all, such a solid patch as shown in FIG. 13 is formed with five varying application voltages to the compression roller 55K, i.e., −50V, −25V, ±0V, +25V, and +50V in the vicinity of a voltage used before the patch sequence, or a voltage of +300V with respect to the application voltage to the developing roller 54K at the time of apparatus activation. During such patch formation, the patch density is checked for every voltage change, and when the density reaches any predetermined value, the patch sequence is ended, and the application voltage at this time is used as a reference value.

Figure 20:
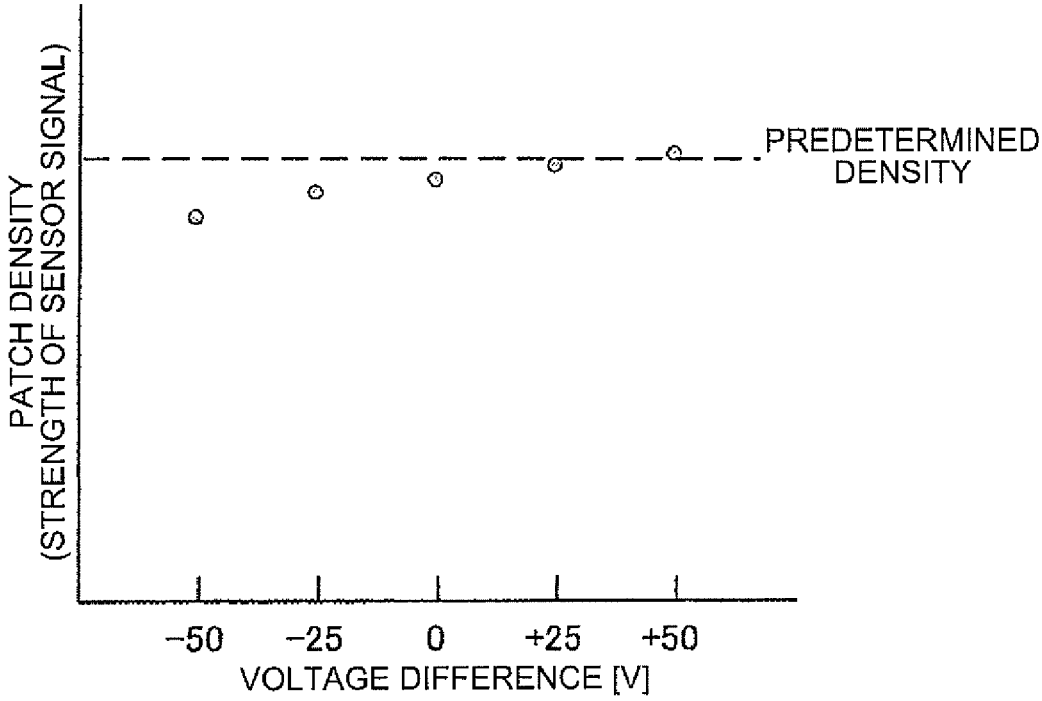
FIG. 20 is a diagram showing the patch density with respect to a compression roller application voltage.

FIG. 20 shows the patch density with respect to the application voltage to the developing roller 55K, i.e., the signal strength of a patch sensor. The graph of the patch density may indicate an upward increase as shown in FIG. 20, or may indicate a downward decrease on the contrary. This is because the factors of a quality change occurred to a developer vary, and the type of the factors changes the tendency of the change.

Figure 21:
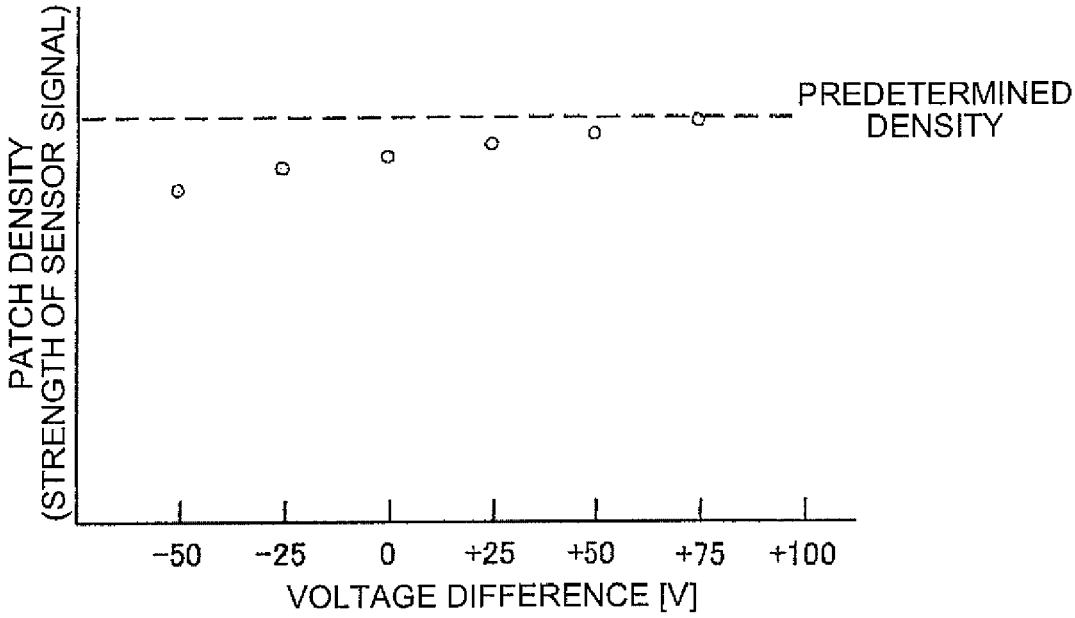
FIG. 21 is another diagram showing the patch density with respect to the compression roller application voltage.

When no appropriate value is derived, the tendency of the change is referred to before forming a patch, i.e., increments or decrements of 25V to the side showing the higher density as shown in FIG. 21. When the density reaches a predetermined value, the sequence is ended, and the voltage at this time is used. The current of the compression member at this time is recorded for use as a new reference value. In FIG. 21 example, the voltage is changed to +75V and +100V. Note that, in the first to third examples, the reference value is set to the current of the compression roller 55K at the time of apparatus activation. This is surely not restrictive, and the reference value set to the current of the compression roller 55K at the apparatus activation may be the reference value set before or any predetermined value.

In the first to third examples, the current of the compression roller 55 is always monitored so that a determination is made whether the current of the compression roller 55K is in a predetermined range or not. Alternatively, after a printing job, such monitoring and determination may be made at regular intervals or for every predetermined number of printing papers.

Note here that the patch sequence may be performed not only at the time of apparatus activation but also during a between-paper process in a printing job. As an exemplary setting, a bias to a non-image portion of the photosensitive element 20K is set to +600V, a bias to an image portion is set to +25V, a bias to the developing roller 54K is set to +400V, a bias to the compression roller 55K is set to +800V, a bias to the primary transfer backup roller 61K is set to −200V, and a bias to the secondary transfer roller 81 is set to +1000V.

Figure 22:
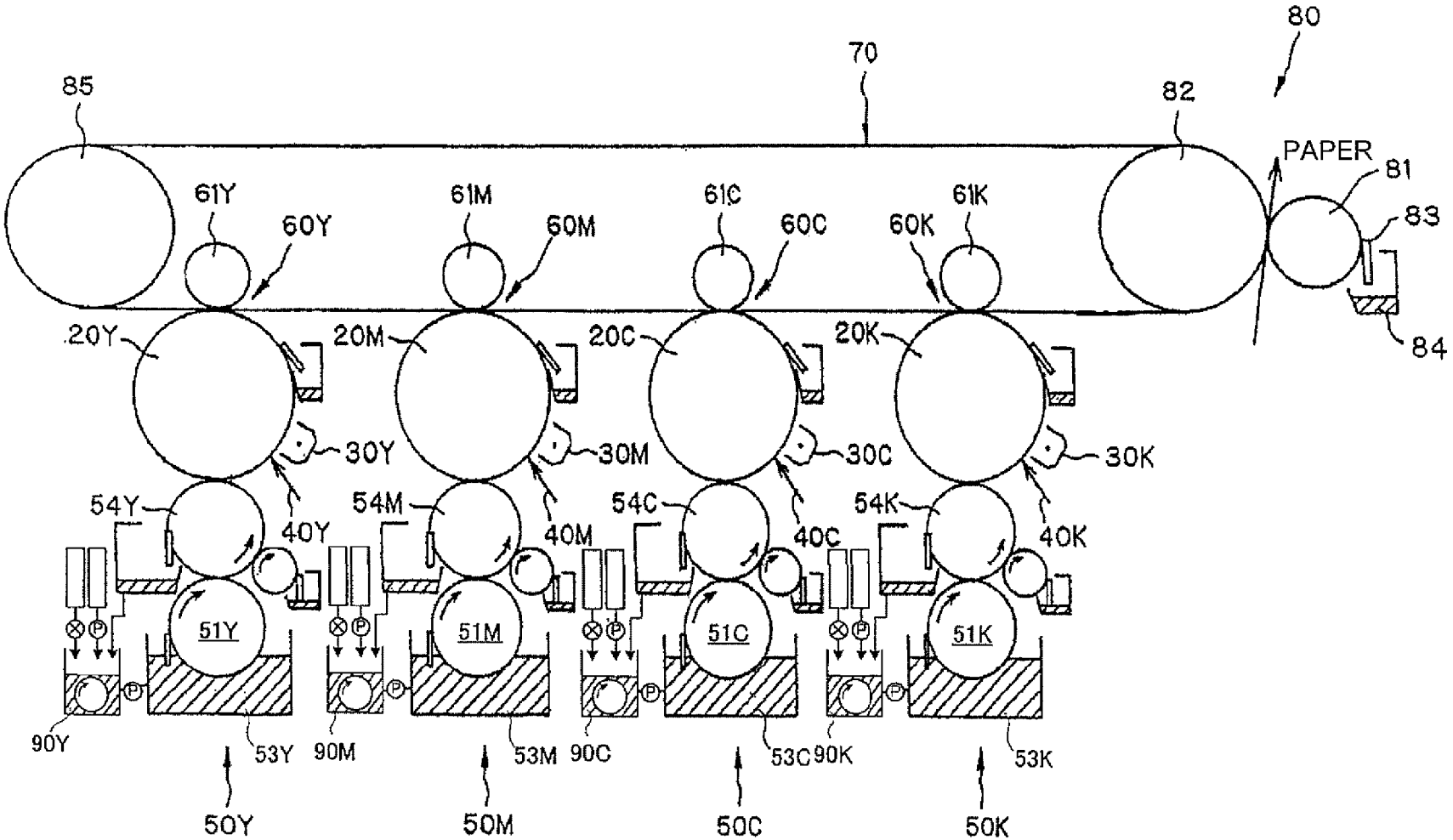
FIG. 22 is a diagram showing an image forming apparatus in a fourth example.
Figure 23:
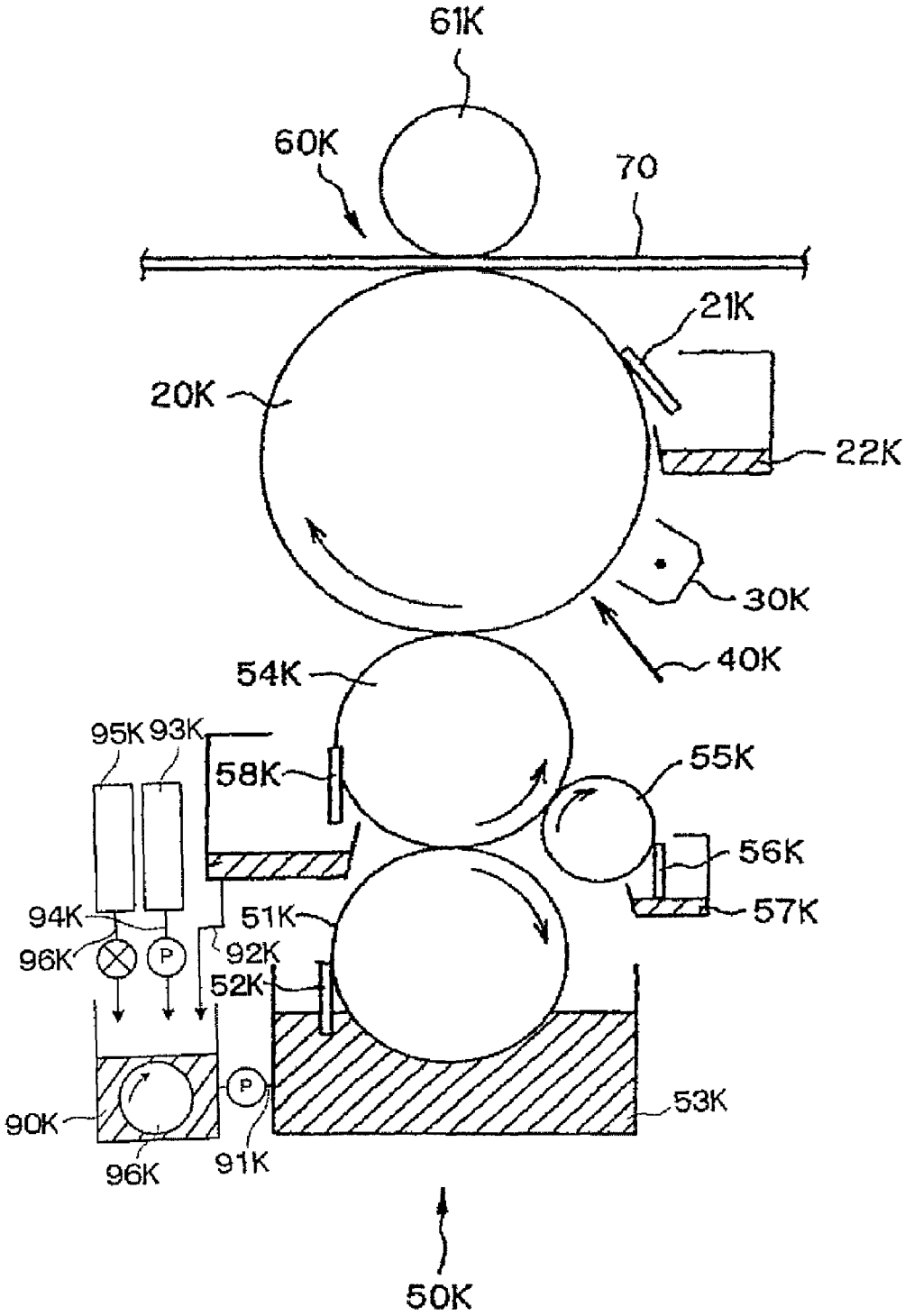
FIG. 23 is a diagram showing a part of the image forming apparatus in the fourth example.

Described next is a fourth example. As shown in FIGS. 22 and 23, in the fourth example, the developing unit 50 is provided for each of a plurality of colors, and a recycling device 9 is provided to each of the developing units 50 for collecting a developer for recycling purpose.

In the fourth example, the developer toner container 53K is provided with a liquid toner adjusted in concentration from a toner adjustment tank 90K through a link pipe 91K including a pump. The toner adjustment tank 90K is provided with a toner (solid concentration of 35%) through a toner supply pipe 94K from a toner tank 93K. The toner is supplied by a pump disposed in the toner supply pipe 94K as is high in viscosity and low in flowability. From a carrier tank 95K, a carrier solution is supplied to the toner adjustment tank 90K through a carrier supply pipe 96K including an open/close valve. The carrier solution is supplied not using a pump but by gravity fall as is low in viscosity. The toner adjustment tank 90K is provided with any collected liquid toner from a developing roller cleaning liquid collection section 59K (will be described later) through a collected liquid toner pipe 92K. The toner adjustment tank 90K carries therein a stirring member 97K.

If such an image forming apparatus is kept running, some disturbance may be observed in images. This is assumed because, as described above, reusing a developer changes the adhesion of a dispersant to toner particles.

Described now is a system of reusing a liquid toner after image development, which is assumed as being a cause of image disturbance. The developing roller blade 58K scrapes off any liquid toner remained on the developing roller 54K, and falls into the developing roller cleaning liquid collection section 59K. The liquid toner collected by the developing roller cleaning liquid collection section 59K is supplied to the toner adjustment tank 90K through the collected liquid toner pipe 92K.

The collected liquid toner is changed in solid concentration compared with the initial solid concentration thereof. This is because, at a developer nip, toner particles in an image portion are mostly subjected to development to the photosensitive element 20K together with a carrier solution, and the carrier solution partially remains on the developing roller 54K. On the other hand, in a non-image portion, the toner particles are mostly remained on the developing roller 54K together with a carrier solution, and the carrier solution is partially transferred onto the photosensitive element 20K. As such, in the liquid toner after the image development, a ratio between the toner particles and the carrier solution remained on the developing roller 54K varies depending on the density of a printing image. With solid image printing, for example, any liquid toner showing a considerably high ratio for the carrier solution is remained on the developing roller 54K, and collected by the developing roller blade 58K into the developing roller cleaning liquid collection section 59K.

The liquid toner collected by the developing roller cleaning liquid collection section 59K is collected into the toner adjustment tank 90K through the collected liquid toner pipe 92K. In the toner adjustment tank 90K, the collected liquid toner is so adjusted as to have the solid concentration of 25%, which is a predetermined value, and a toner (solid concentration of 35%) comes from the toner tank 93K through the toner supply pipe 94K to refill any consumed portion of the liquid toner. Such toner provision is made through a pump because the toner is high in viscosity and low in flowability. From the carrier tank 95K, a carrier solution is supplied to the toner adjustment tank 90K through the carrier supply pipe 96K including an open/close valve. The carrier solution is supplied not using a pump but by gravity fall as is low in viscosity. After homogenizing the toner using the stirring member 97K in the toner adjustment tank 90K, the developer toner container 53K is provided with the concentration-adjusted liquid toner via the link pipe 91K.

When the collected liquid toner passes through an electric field of a compression roller nip or that of a developing roller nip, a phenomenon occurs that a dispersant adhered to the toner particles comes off, and while the collected liquid toner is being repeatedly reused, the amount of dispersant adhered to the toner particles is reduced.

When the adhesion of a dispersant to toner particles is changed from the initial state, the change becomes evident with the different behavior of toner particles in a carrier solution under the electric field between the compression roller 55K and the developing roller 54K, or with the change of resistance of the developer layer. Eventually, any change occurred to the adhesion of a dispersant to toner particles becomes evident with a change of a current flowing from the compression roller 55K to the developing roller 54K. In the invention, attention is focused on such a respect, and a change of a current flowing from the compression roller 55K to the developing roller 54K is used as a basis to estimate the degree of adhesion of a dispersant to toner particles. When the detected current value falls outside a predetermined value range, a dump mode is activated to dump entirely the liquid toner being in use so that any possible image disturbance is prevented from occurring.

Figure 24:
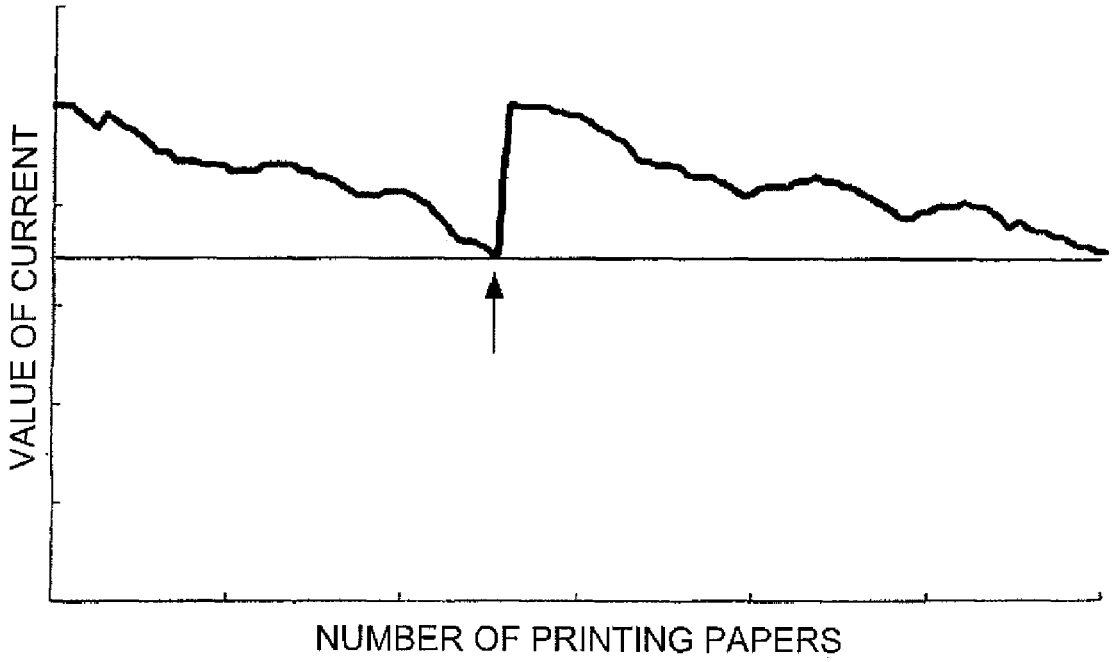
FIG. 24 is a diagram showing a current value with respect to the number of printing papers.

As shown in FIG. 24, the current value to be detected by the current detection unit A is decreased by degrees as the number of printing papers is increased. When the detected current value reaches a lower limit of the predetermined value, a dump mode is activated to dump entirely the liquid toner being in use.

Figure 25:
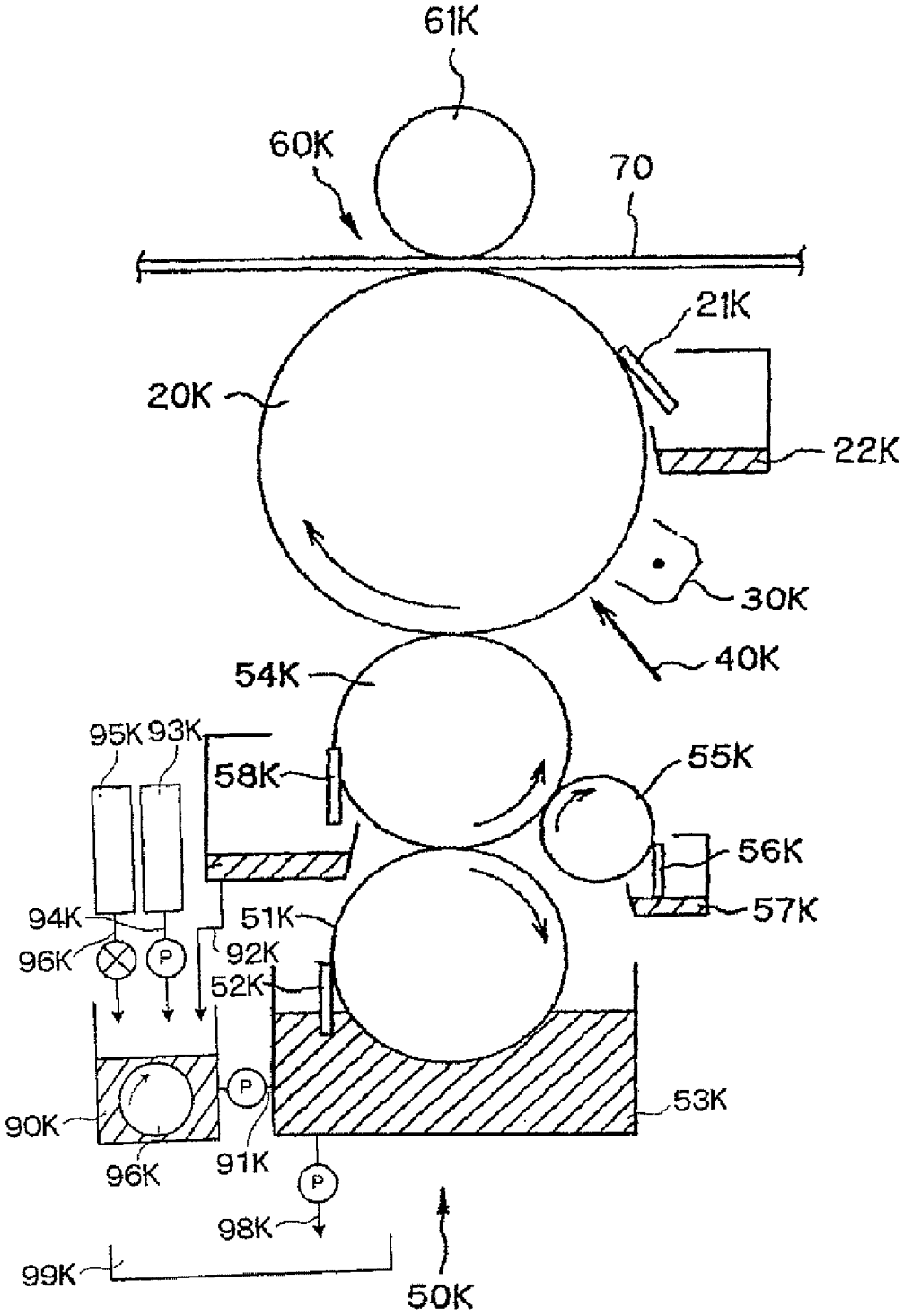
FIG. 25 is another diagram showing a part of the image forming apparatus in the fourth example.

FIG. 25 shows an example of activating the dump mode for a liquid toner. The developer toner container 53K is linked to a dumped liquid toner tank 99K by a liquid toner dump pipe 98K including a pump. Note that the liquid toner dump pipe 98K and the dumped liquid toner tank 99K are each merely an example of the liquid developer dump unit.

As shown in FIG. 24, when a current flowing from the compression roller 55K to the developing roller 54K reaches a lower limit of the predetermined value, a dump mode is activated to dump entirely the liquid toner being in use.

The dump mode is activated as below.

1. In a developing unit, every roller is stopped being driven.

2. In the toner supply pipe 94K of the toner tank 93K for use for a toner supply to the toner adjustment tank 90K, the pump is stopped in operation, and the open/close valve in the carrier supply pipe 96K of the carrier tank 95K is closed.

3. In the liquid toner dump pipe 98K linking between the developer toner container 53K and the dumped liquid toner tank 99K, the pump is driven to start operation, and the liquid toner in the developer toner container 53K is dumped into the dumped toner tank 99K.

4. At the same time, in the link pipe 91K linking between the toner adjustment tank 90K and the developer toner container 53K, the pump is driven to move the liquid toner in the toner adjustment tank 90K to the developer toner container 53K. The liquid toner is then dumped into the dump toner tank 99K.

5. The pumps are both driven for a predetermined length of time, and the toner adjustment tank 90K and the developer toner container 53K are both emptied out. The pumps are then stopped being driven.

6. To the toner adjustment tank 90K now being empty, the pump disposed in the toner supply pipe 94K is driven to make a supply of a new toner (solid concentration of 35%) from the toner tank 93K, and the open/close valve disposed in the carrier supply pipe 96K is opened to make a supply of a new carrier solution from the carrier tank 95K. The toner is then so homogenized as to have the solid concentration of 25% through rotation of the stirring member 97K in the toner adjustment tank 90K. Thereafter, the pump in the link pipe 91K linked to the developer toner container 53K is driven to make a supply of a new liquid toner, which has been adjusted in concentration.

7. An image forming apparatus is started in operation.

With the dump mode activated as such, as shown in FIG. 24, the image forming operation is resumed using a new liquid toner through with concentration adjustment with the dump mode activated, the current flowing from the compression roller 55K to the developing roller 54K is increased. When the current value reaches a lower limit of a predetermined value, the above-described dump mode is activated so that the value of the current flowing from the compression roller 55K to the developing roller 54K is kept to the predetermined value or higher. This thus favorably leads to images of high quality.

Such value detection of a current flowing from the compression roller 55K to the developing roller 54K and activation of a dump mode are separately performed for each color, thereby deriving a high-quality full-color image.

As such, any change occurred to the characteristics of a developer, i.e., any change observed in the carrier viscosity and conductivity, and any change observed in the mobility and electric-charge characteristics of toner particles in an electric field due to a change of the amount and state of adhesion of a dispersant to the toner particles, becomes evident with a change of a current flowing during a process of applying a bias voltage to the compression roller 55K and compressing the toner particles toward the developing roller 54K. By monitoring such a current, any change occurring to a developer is determined, and a patch is formed as needed so that image forming requirements leading to an appropriate image density are to be set again. In this manner, even if the developer suffers from any change, the resulting images can be of a satisfactory level.

As such, with the configuration of the developing unit 50K in the embodiment, including: the developing roller 54K that carries thereon a liquid developer being a carrier solution including dispersed toner particles each made of a coloring agent and a resin; the toner supply roller 51K that supplies the developer to the developing roller 54K; the compression roller 55K that is opposing the developing roller 54K, and compresses any solid content of the developer to the side of the developing roller 54K through application of an electric field to the developer on the developing roller 54K supplied by the toner supply roller 51K; the compression roller voltage application unit 92 that applies a voltage to the compression roller 55K; and the current detection unit A that detects a current flowing from the compression roller 55K to the developing roller 54K. This configuration successfully enables detection of any change occurring to the characteristics of a developer based on fluctuations of a current, thereby enabling to quickly dealing with any problems if occurred.

The current detection unit A performs averaging of a current value, for use as a detection value, being a result of performing current detection for a predetermined length of time. As such, the detection can be performed with good accuracy.

The tone supply roller 51K is an anilox roller formed with microscopic asperities on the surface so that the developer can be supplied with stability.

Moreover, the compression roller voltage application unit 92K includes a constant voltage control unit so that the solid content of a developer can be moved with stability.

A developing roller voltage application unit 91K is provided for applying a voltage to the developing roller 54K and the toner supply roller 51K, and the developing roller voltage application unit 91K includes a constant voltage control unit. With the configuration, a developer can be supplied with stability, and the solid content of the developer can be moved also with stability.

An image forming apparatus using the image development unit 50K of the invention includes: a liquid developer dump unit that includes: the photosensitive element 20K that is subjected to development of a latent image by the developing roller 54K; and a recycling device 9 that reclaims, for reuse, any of the developer on the developing roller 54K corresponding to a non-image portion of the photosensitive element 20K. The liquid developer dump unit entirely dumps the developer being in use based on data of the current detection unit A so that any possible image disturbance can be prevented from occurring without using any deteriorated developer.

The current detection unit A and the liquid developer dump units 98K and 99K are disposed in the image development unit 50, which is provided for each of a plurality of colors so that a full-color image can be derived with high quality.

Moreover, a patch process is performed in accordance with the current detected by the current detection unit A, and based on a patch density, a setting is made for image forming requirements. Accordingly, any change occurring to a developer is determined, and a patch is formed as needed so that image forming requirements leading to an appropriate image density are to be set again. In this manner, even if the developer suffers from any change, the resulting images can be of a satisfactory level.

Moreover, when the current detected by the current detection unit A falls outside a predetermined range of a reference value set therefor at the time of activating the image forming apparatus, the patch process is performed, and the setting is made for the image forming requirements based on the patch density. Accordingly, the patch process can be executed with good accuracy.

The image forming requirements are an application voltage of the developing roller 54K and that of the photosensitive element 20K so that the resulting image can be high in quality.

What is claimed is:

1. An image forming apparatus comprising:

an image development apparatus, comprising:

a developer carrier that carries thereon a liquid developer being a carrier solution including dispersed toner particles each made of a coloring agent and a resin;

a developer supply member that supplies the developer to the developer carrier;

a developer compression member that is opposing the developer carrier, and compresses any solid content of the developer to a side of the developer carrier through application of an electric field to the developer on the developer carrier supplied by the developer supply member;

a developer compression member voltage application unit that applies a voltage to the developer compression member; and a current detection unit that detects a current flowing from the developer compression member to the developer carrier; and a liquid developer dump unit that includes:

an image carrier that is subjected to development of a latent image by the developer carrier; and a recycling device that collects, for reuse, any of the developer on the developer carrier corresponding to a non-image portion of the image carrier, and entirely dumps the developer being in use based on data of the current detection unit.

2. The image forming apparatus according to claim 1, wherein the current detection unit performs averaging of a current value, for use as a detection value, being a result of performing current detection for a predetermined length of time.

3. The image forming apparatus according to claim 1, wherein the developer supply member is an anilox roller formed with microscopic asperities on a surface.

4. The image forming apparatus according to claim 1, wherein the developer compression member voltage application unit includes a constant voltage control unit.

5. The image forming apparatus according to claim 1, further comprising a developer carrier voltage application unit that applies a voltage to the developer carrier and the developer supply member, wherein the developer carrier voltage application unit includes a constant voltage control unit.

6. The image forming apparatus according to claim 1, wherein the current detection unit and the liquid developer dump unit are disposed in the image development apparatus, which is provided for each of a plurality of colors.

7. The image forming apparatus of claim 1, wherein a patch process is performed in accordance with the current detected by the current detection unit, and based on a patch density, a setting is made for image forming requirements.

8. The image forming apparatus according to claim 7, wherein when the current detected by the current detection unit falls outside a predetermined range of a reference value set therefor at a time of activating the image forming apparatus, the patch process is performed, and the setting is made for the image forming requirements based on the patch density.

9. The image forming apparatus according to claim 7, wherein the image forming requirements are an application voltage of the developer carrier and that of the image carrier.

* * * * *